US008050578B2

(12) United States Patent
Kurokawa

(10) Patent No.: US 8,050,578 B2
(45) Date of Patent: Nov. 1, 2011

(54) IMAGE FORMING APPARATUS TO HEAT AND FIX A TONER IMAGE ONTO A PRINT MEDIUM

(75) Inventor: Koji Kurokawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 391 days.

(21) Appl. No.: 12/233,809

(22) Filed: Sep. 19, 2008

(65) Prior Publication Data

US 2009/0080926 A1 Mar. 26, 2009

(30) Foreign Application Priority Data

Sep. 20, 2007 (JP) ..... 2007-244138

(51) Int. Cl.
*G03G 15/00* (2006.01)

(52) U.S. Cl. ..... 399/44

(58) Field of Classification Search ..... 399/44
See application file for complete search history.

(56) References Cited

U.S. PATENT DOCUMENTS

| | | | | |
|---|---|---|---|---|
| 6,006,051 | A * | 12/1999 | Tomita et al. | 399/69 |
| 6,389,247 | B1 * | 5/2002 | Chung | 399/69 |
| 6,390,696 | B1 * | 5/2002 | Concannon | 400/120.01 |
| 2004/0165897 | A1 * | 8/2004 | Hooper et al. | 399/44 |

FOREIGN PATENT DOCUMENTS

| | | |
|---|---|---|
| JP | 08-123274 A | 5/1996 |

* cited by examiner

*Primary Examiner* — David Porta
*Assistant Examiner* — Carolyn Igyarto
(74) *Attorney, Agent, or Firm* — Panitch Schwarze Belisario & Nadel LLP

(57) ABSTRACT

An image forming apparatus is supplied that can obtain a correct temperature inside an image forming section and can perform an optimum temperature control so that it is possible to prevent remainder toner on the surface of the image carrying body from solidifying. In the image forming apparatus, in order to heat and fix toner image onto print medium, an image forming section forms the toner image on surface of an image carrying body; a conveying section conveys the print medium; a transferring section transfers the toner image on the image carrying body onto the print medium conveyed by the conveying section; a fixing section heats and fixes the toner image transferred on the print medium; a fixing section temperature detection section detects a temperature of the fixing section; an apparatus controlling section controls the temperature of the fixing section on the basis of a detection result of the fixing section temperature detection section; and an inner temperature detection section detects an image forming apparatus inner temperature, wherein the inner temperature detection section is set up in a location outside the image forming section, where temperature changes due to a heat influence from the fixing section as that a toner accommodating portion inside the image forming section has the same heat influence, and the apparatus controlling section sets a temperature setting value of the fixing section on the basis of a detection result of the inner temperature detection section.

11 Claims, 7 Drawing Sheets

| APPARATUS SIDE TEMPERATURE t (°C) | PRINT MEDIUM CONVEYANCE SPEED ( ppm ) | HEATING ROLLER SURFACE TEMPERATURE (°C) |
|---|---|---|
| $t \leqq 42$ | 20 | 170 |
| $42 < t \leqq 47$ | 10 | 130 |
| $t > 47$ | PRINT MEDIUM CONVEYANCE STOPPAGE | STOPPING SUPPLY OF VOLTAGE TO HEATER |

| APPARATUS SIDE TEMPERATURE t (°C ) | PRINT MEDIUM CONVEYANCE SPEED ( ppm ) | HEATING ROLLER SURFACE TEMPERATURE (°C ) |
|---|---|---|
| $t \leqq 42$ | 20 | 170 |
| $42 < t \leqq 45$ | 16 | 155 |
| $45 < t \leqq 47$ | 10 | 130 |
| $t > 47$ | PRINT MEDIUM CONVEYANCE STOPPAGE | STOPPING SUPPLY OF VOLTAGE TO HEATER |

*FIG. 9*

IMAGE FORMING APPARATUS TO HEAT AND FIX A TONER IMAGE ONTO A PRINT MEDIUM

BACKGROUND OF THE INVENTION

1. Field of the Invention

The invention relates to an image forming apparatus to heat and fix a toner image in print medium.

2. Related Background Art

Until now, as a kind of an image forming apparatus, for example, as disclosed in a patent document 1, it is proposed that uses a cleaning roller to scrape and remove remainder toner remaining on the surface of an image carrying body. In the image forming apparatus, in order to prevent that the temperature inside the image forming section rises along with a heating and fixing process in a fixing section so that the remainder toner occurs a solidification of the remainder toner and adheres to the surface of the image carrying body and the cleaning roller, a temperature sensor is set to connect with the shaft of the cleaning roller, through the temperature sensor, a control of heating temperature of heater that is furnished in a fixing roller of the fixing section is performed to set the temperature detected by the temperature sensor to be under a temperature that is previously decided by experiment and can make the remainder toner does occur solidification.

Patent document 1: Japan patent publication 8-123274.

However, in the image forming apparatus, because the temperature sensor is furnished near to the fixing section, the temperature sensor obtains an influence of heat produced by the heater of the fixing section, and detects a temperature that is higher than a fact temperature inside the image forming section. For this, in the image forming apparatus, it is impossible to control an optimum temperature because a correct temperature inside the image forming section can not be detected, so that it is impossible to prevent the adherence of the remainder toner on the surface of the image carrying body and the like.

For measuring the temperature correctly, for example, it can be considered to furnish a temperature sensor in the image forming section. But, with respect to the image forming section of removable attachment type, it is difficult to ensure a connection relation between the temperature sensor and the apparatus side. Further, in the image forming apparatus that seeks a small size, it is difficult to ensure wiring space in the image forming section, so that the temperature sensor can not be furnished.

SUMMARY OF THE INVENTION

It is, therefore, an objective of the invention to provide an image forming apparatus capable of solving the above problem. That is, the image forming apparatus can obtain a correct temperature an image forming section and can perform an optimum temperature control, so that it is possible to prevent an adherence of remainder toner on the surface of the image carrying body and the like.

An aspect of the image forming apparatus is to provide an image forming apparatus to heat and fix toner image onto print medium. The image forming apparatus comprises:

an image forming section that forms the toner image on surface of an image carrying body;

a conveying section that conveys the print medium;

a transferring section that transfers the toner image on the image carrying body onto the print medium conveyed by the conveying section;

a fixing section that heats and fixes the toner image transferred on the print medium;

a fixing section temperature detection section that detects a temperature of the fixing section;

an apparatus controlling section that controls the temperature of the fixing section on the basis of a detection result of the fixing section temperature detection section; and an inner temperature detection section that detects an image forming apparatus inner temperature, wherein the inner temperature detection section is set up in a location outside the image forming section, where temperature changes due to a heat influence from the fixing section as that a toner accommodating portion inside the image forming section has the same heat influence, the apparatus controlling section sets a temperature setting value of the fixing section on the basis of a detection result of the inner temperature detection section.

EFFECT OF THE PRESENT INVENTION

According to the invention, because the inner temperature detection section is set up in a location outside the image forming section, where temperature changes due to a heat influence from the fixing section as that a toner accommodating portion inside the image forming section has the same heat influence, and the apparatus controlling section sets a temperature setting value of the fixing section on the basis of a detection result of the inner temperature detection section, it is possible to obtain a correct temperature inside the image forming section and perform an optimum temperature control. As a result, it is possible to prevent an adherence of the remainder toner on the surface of the image carrying body and the like.

The above and other objects and features of the present invention will become apparent from the following detailed description and the appended claims with reference to the accompanying drawings.

BRIEF DESCRIPTION OF THE DRAWINGS

FIG. 9 is a second diagram showing a structure of a print control prescription information storing section in embodiment of the present invention.

DETAILED DESCRIPTION OF THE PREFERRED EMBODIMENTS

Embodiments of the invention will be described in detail hereinbelow with reference to the drawings.

Structure of Embodiment

An image forming apparatus 100 of the embodiment of the present invention, for example, is a printer that performs an image formation on the basis of image data obtained from a host apparatus such as PC (Personal Computer) that is connected to network, for example, is instructed to user's house. Here, in the present embodiment, it is to explain the image forming apparatus 100 when it is a printer. However, it is not limited by the embodiment, the image forming apparatus also may be a MFP (Multi Function Products).

Figure 1:
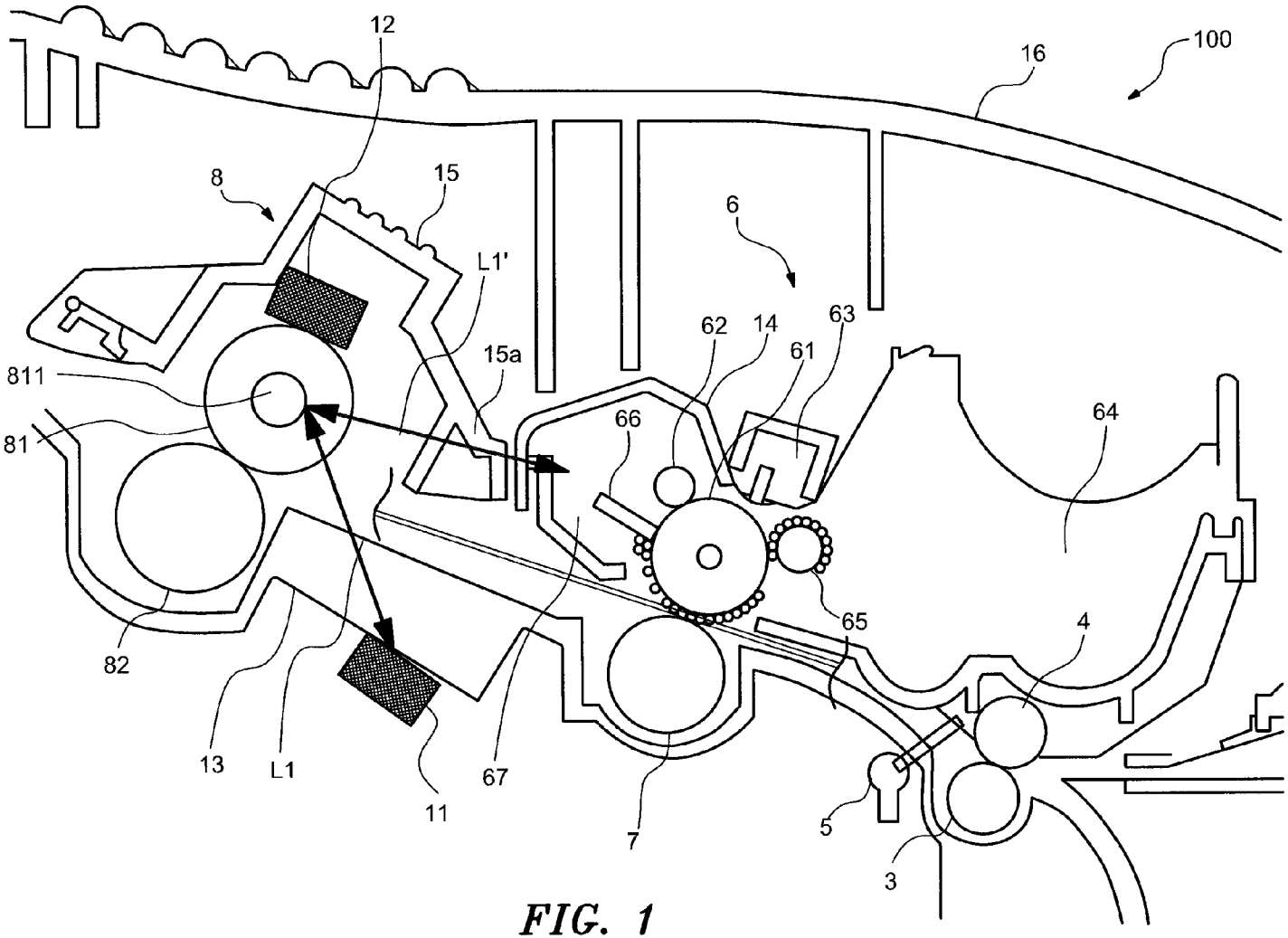
FIG. 1 is a first structure diagram of an image forming apparatus when it is a printer in embodiment of the present invention.
Figure 2:
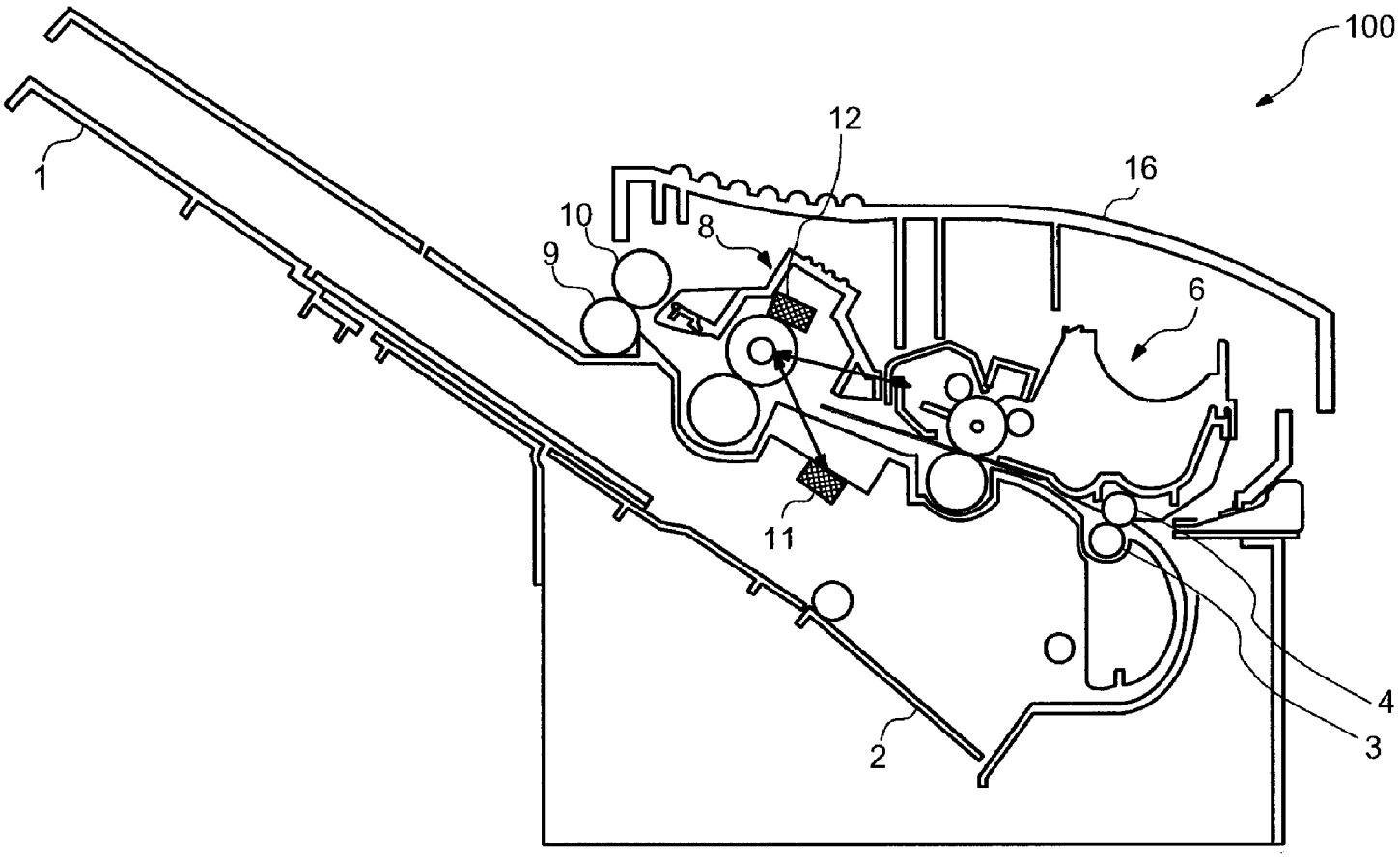
FIG. 2 is a second structure diagram of an image forming apparatus when it is a printer in embodiment of the present invention.

The image forming apparatus 100, as shown by FIG. 1 and FIG. 2, includes a paper feed cassette 1, a medium stage 2, a conveying roller 3, a pressing roller 4, a passage sensor 5, an image formation unit 6, a transferring roller 7, an image fixing unit 8, an ejecting roller 9, a pressing roller 10, an apparatus side thermistor 11, a heating roller use thermistor 12, a conveying route frame 13, an image forming section mold 14, an image fixing section mold 15 and a top cover 16.

The image formation unit 6, is a mechanism to form a toner image, as shown by FIG. 1, is composed of a photosensitive drum 61, an charging roller 62, a LED head 63, a toner tank 64, a developing roller 65, a cleaning blade 66 and a remainder toner collecting section 67. Here, the image formation unit 6 is possible to attach to and remove from the apparatus main body of the image forming apparatus 100.

The image fixing unit 8 is a mechanism to fix the toner image onto print medium, as shown by FIG. 1, is composed of a heating roller 81 and a pressing roller 82. Here, the heating roller 81 has a heater 811 for heating the heating roller 81, inside the roller.

Figure 3:
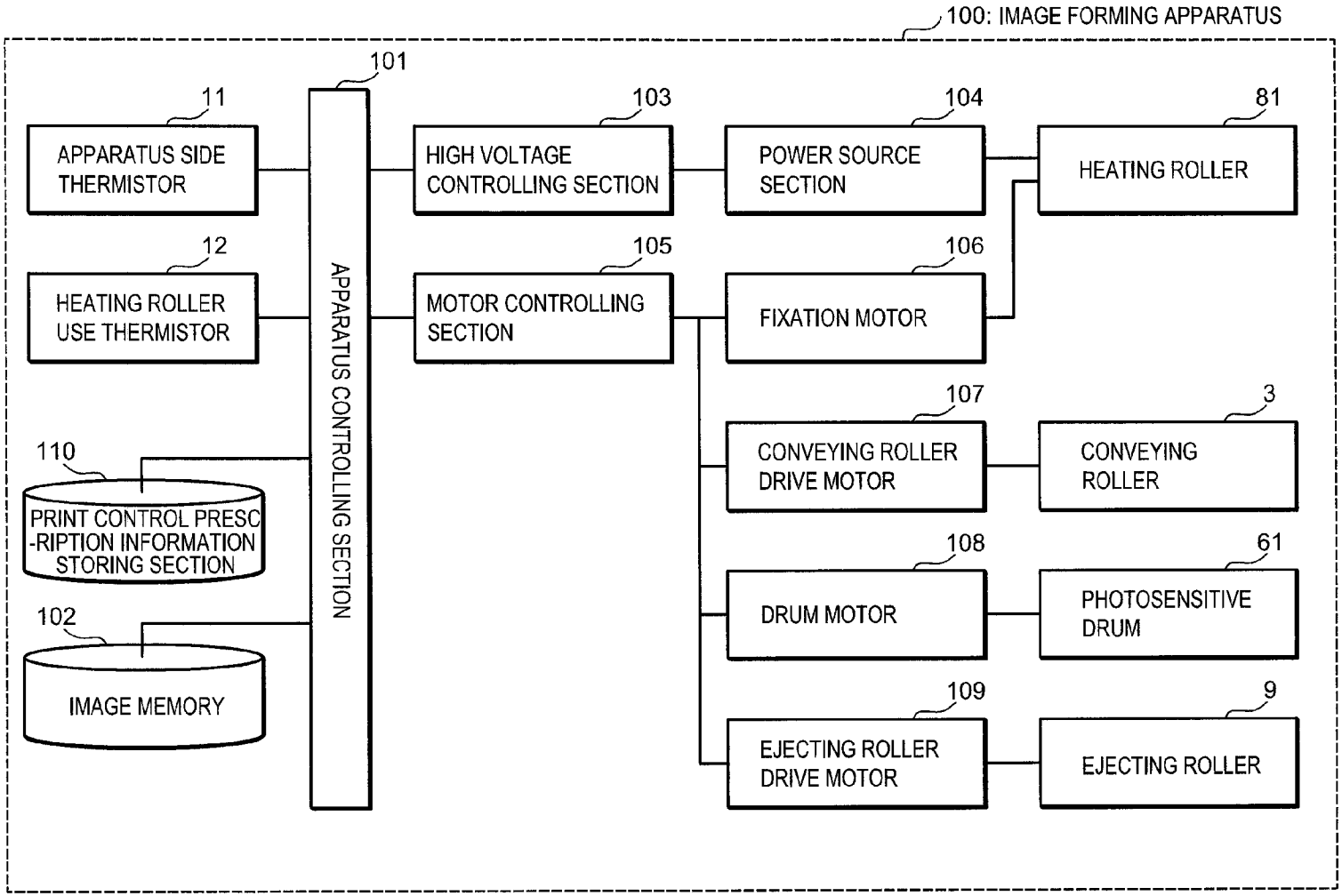
FIG. 3 is a block diagram showing a structure of an image forming apparatus in embodiment of the present invention.

Then, the image forming apparatus 100, as shown by FIG. 3, adding to the structure, includes an apparatus controlling section 101 to control the whole apparatus, an image memory 102, a high voltage controlling section 103, an power source section 104, a motor controlling section 105, a fixation motor 106, a conveying roller drive motor 107, a drum motor 108, an ejecting roller drive motor 109 and a print control prescription information storing section 110.

On the one hand, when the image forming apparatus 100 obtains image data from a host apparatus through an I/F (Inter/Face) section (not shown), the image data is stored into the image memory 102 by a control of the apparatus controlling section 101. Here, the I/F is a communicating section that receives the image data from the host apparatus and performs a notification of a process result of the received image data. The I/F may be a serial interface such as USB (Universal Serial Bus) or the like; also may be a parallel interface such as IEEE1284 or the like, and it is connected to the host apparatus in predetermined protocol of each interface.

On the other hand, when the user sets up a manuscript on a reading section (not shown) of the image forming apparatus 100 and instructs a print through a button providing in an inputting section that is not illustrated, the reading section reads out the manuscript and forms image data. When the reading section formed the image data, the image data is stored into the image memory 102 by a control of the apparatus controlling section 101.

When the image data was stored in the image memory 102, through a control of the apparatus controlling section 101, the motor controlling section 105 supplies voltage of the power source section 104 to medium stage drive motor (not shown) and to the paper feeding roller drive motor (not shown) of the image forming apparatus 100 to drive the medium stage drive motor and the paper feeding roller drive motor.

The paper feed cassette 1 is a holding section for holding print medium and can holds print medium of A4 size (210 mm×297 mm) and letter size (215.9 mm×279.4 mm), and may has a longer shape in lengthwise instruction so as to correspond to such print medium of, for example, legal size (215.9 mm×355.6 mm).

The medium stage 2 is a stage for locating tip side of the print medium held by the paper feed cassette 1, through moving upwardly along with a drive of the medium stage drive motor, the medium stage 2 sends the print medium of most upside to a conveyance route.

On the one hand, through a drive of the medium stage drive motor, the medium stage 2 moves to upside. Here, the motor controlling section 105 controls the drive of the medium stage drive motor to move the medium stage 2 upwardly, so that the front edge of the print medium held on the most upside in the medium stage 2 reaches the height of the conveyance route. Through moving the medium stage 2 upwardly, the print medium on the most upside is sent along a instruction of a paper feeding roller (not shown) of the image forming apparatus 100.

On the other hand, through a drive of the paper feeding roller drive motor, the paper feeding roller (not shown) of the image forming apparatus 100 starts to rotate. By this, the paper feeding roller conveys the print medium that was sent from the medium stage 2, for a paper feed.

Through the control of the apparatus controlling section 101 together with the paper feeding roller feeds the print medium, the motor controlling section 105 supplies voltage of the power source section 104 to the conveying roller drive motor 107 used for making the conveying roller 3 rotate; to the drum motor 108 used for making the photosensitive drum 61 rotate; to the fixation motor 106 used for making the heating roller 81 rotate and to the ejecting roller drive motor 109 used for making the ejecting roller 9 rotate, so as to drive the conveying roller drive motor 107, the drum motor 108, the fixation motor 106 and the ejecting roller drive motor 109.

Through a drive of the conveying roller drive motor 107, the conveying roller 3 starts to rotate. By this, the print medium that was conveyed from the paper feeding roller is sandwiched by the conveying roller 3 and the pressing roller 4 that was set up to face to the conveying roller 3, and is conveyed.

When the front edge of the print medium that is sandwiched by the conveying roller 3 and the pressing roller 4 to be conveyed reaches the passage sensor 5, through a control of the apparatus controlling section 101, the charging roller 62 charges the surface of the photosensitive drum 61.

After the surface of the photosensitive drum 61 is charged, for example, the LED head 63 formed by arranging LED (Light Emitting Diode) arrays emits light through a control of the apparatus controlling section 101, so as to form an electrostatic latent image on the surface of the charging photosensitive drum 61 on the basis of image data held in the image memory 102. Here, the electrostatic latent image on the surface of the charging photosensitive drum 61, through the control of the apparatus controlling section 101, is formed according to a location of the front edge of the print medium.

After the electrostatic latent image is formed on the surface of the photosensitive drum 61, toner that is contained in the toner tank 64, is used to develop the electrostatic latent image on the photosensitive drum 61 via the developing roller 65, through a control of the apparatus controlling section 101. By this, on the surface of the photosensitive drum 61, a toner image corresponding to the electrostatic latent image is formed as a visible image.

After the toner image is formed on the photosensitive drum 61, through a control of the apparatus controlling section 101, the print medium is sandwiched by the photosensitive drum 61 and the transferring roller 7 to be conveyed; and the toner image on the surface of the photosensitive drum 61 is transferred onto the print medium by the transferring roller 7. Here, through a control of the apparatus controlling section 101, the transferring roller 7 is provided with a high voltage that serves as a transference voltage outputted from the power source section 104.

After the toner image on the surface of the photosensitive drum 61 is transferred on the print medium, toner (i.e. remainder toner) remaining on the surface of the photosensitive drum 61 is scraped to be removed by the cleaning blade 66. Then, the scraped remainder toner is collected by the remainder toner collecting section 67.

While the toner image on the surface of the photosensitive drum 61 is transferred onto the print medium, through a control of the apparatus controlling section 101, the surface of the heating roller 81 is heated to a heating roller prescription temperature stated later by a heater 811 that was set up in the heating roller 81. Here, through a control of the apparatus controlling section 101, the heater 811 is provided with a high voltage outputted from the power source section 104 to heat via the high voltage controlling section 103

Then, when the print medium on which the toner image was transferred is sandwiched to be conveyed by the heating roller 81 that was heated to the heating roller prescription temperature and by and the pressing roller 82 that was set up to face to the heating roller 81, the toner image on the print medium is heated and is pressed by the heating roller 81 and the pressing roller 82, then is fixed on the print medium.

The print medium on which a fixation process is performed by the heating roller 81 and the pressing roller 82 is sandwiched to be conveyed by the rotating ejecting roller 9 and the pressing roller 10 that was set up to face to the ejecting roller 9, and is ejected from an ejection opening (not shown) of the image forming apparatus 100. By this, a print process concerning one sheet of print medium in the image forming apparatus 100 is completed.

Further, when a switch (not shown) of the image forming apparatus 100 is pressed and a voltage is supplied from the power source section 104, the apparatus controlling section 101 executes the control stated above; and obtains temperature detection signals from the apparatus side thermistor 11 and the heating roller use thermistor 12 above mentioned.

On the one hand, the apparatus side thermistor 11 is a temperature sensor that detects a temperature in a predetermined location at apparatus side that is influenced by heat outputted from the heater 811 that was set up in the heating roller 81, in a same condition as that in the image formation unit 6. Here, the apparatus side thermistor 11, as shown by FIG. 1, is set up in a back location of a conveyance route frame 13, whose distance from the heater 811 is "L1". As shown by FIG. 1, such setting of the apparatus side thermistor 11 is decided so that the thickness of the conveyance route frame 13 is almost equal to the sum of respective thicknesses of an image forming section mold 14 and an expanding section 15*a* of an image fixing section mold 15. Then, as shown by FIG. 1, the distance "L1" stated above, is equal to a distance "L1'" from the heater 811 to the predetermined location that was previously set, in the image formation unit 6.

Figures 4, 5:
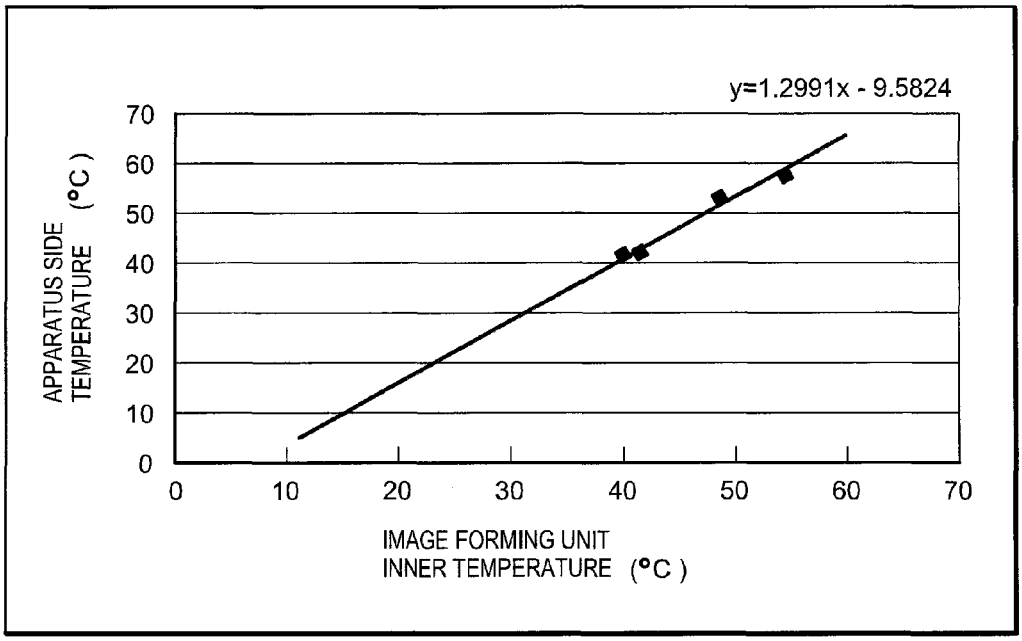
FIG. 4 is a graph showing a relation of a temperature inside an image forming unit and an temperature of apparatus side in embodiment of the present invention.
FIG. 5 is a first diagram showing a structure of a print control prescription information storing section in embodiment of the present invention.

A relation between an apparatus side temperature which represents a temperature of the predetermined location of the image forming apparatus 100, was previously measured by an experiment and is detected by the apparatus side thermistor 11, and a temperature inside the image formation unit, which represents a detection temperature inside the image formation unit 6 and is detected by using thermocouple for experiment, is shown by the FIG. 4. In the FIG. 4, for example, when the temperature inside the image formation unit is equal to 30° C., the apparatus side temperature is 30° C. Further, in the FIG. 4, for example, when the temperature in the image formation unit is equal to 50° C., the apparatus side temperature is 55° C. When the apparatus side temperature is set into "y" and the temperature inside the image formation unit is set into "x", as shown by FIG. 4, a relation of $y=1.2991x-9.5824$ is formed. Because the heat occurring in the heater 811 is almost equally transmitted to the inside of the image formation unit and to the the apparatus side thermistor 11, the apparatus side temperature is set as the temperature inside the image formation unit.

The apparatus side thermistor 11 detects the temperature of the predetermined location of the apparatus side, that is, detects the apparatus side temperature.

On the other hand, the heating roller use thermistor 12 is a temperature sensor which is set up on the upside of the heating roller 81 and detects a surface temperature of the heating roller 81 for controlling the surface temperature of the heating roller 81. Here, the heating roller use thermistor 12 is set up to contact to the surface temperature of the heating roller 81.

That is, the heating roller use thermistor 12 detects a fixing roller surface temperature that represents a temperature on the surface of the heating roller 81 inside which that the heater 811 is set up.

The print control prescription information storing section 110, on the basis of the apparatus side temperature that was detected by the apparatus side thermistor 11, is a storing section that stores the print control prescription information for controlling the print medium conveyance speed and the surface temperature of the heating roller 81. Here, the print control prescription information, as shown by FIG. 5, when the apparatus side temperature is 42° C. or less, is set up for controlling that the print medium conveyance speed is equal to 20 ppm (page per minutes: printable pages within one minute) and the surface temperature of the fixing roller is equal to 170° C.

Further, the print control prescription information, as shown by FIG. 5, when the apparatus side temperature is higher than 42° C. but is 47° C. or less, is set up for controlling that the print medium conveyance speed is equal to 10 ppm and the surface temperature of the fixing roller is equal to 130° C.

Furthermore, the print control prescription information, as shown by FIG. 5, when the apparatus side temperature exceeds 47° C., is set up for stopping the conveyance of the print medium and for not performing to provide a high voltage outputted from the power source section 104 to the fixation motor 106 used to drive the heating roller 81.

Next, it is to explain in detail a calculation method of respective control values stated above of the print control prescription information held in the print control prescription information storing section 110.

Figure 6:
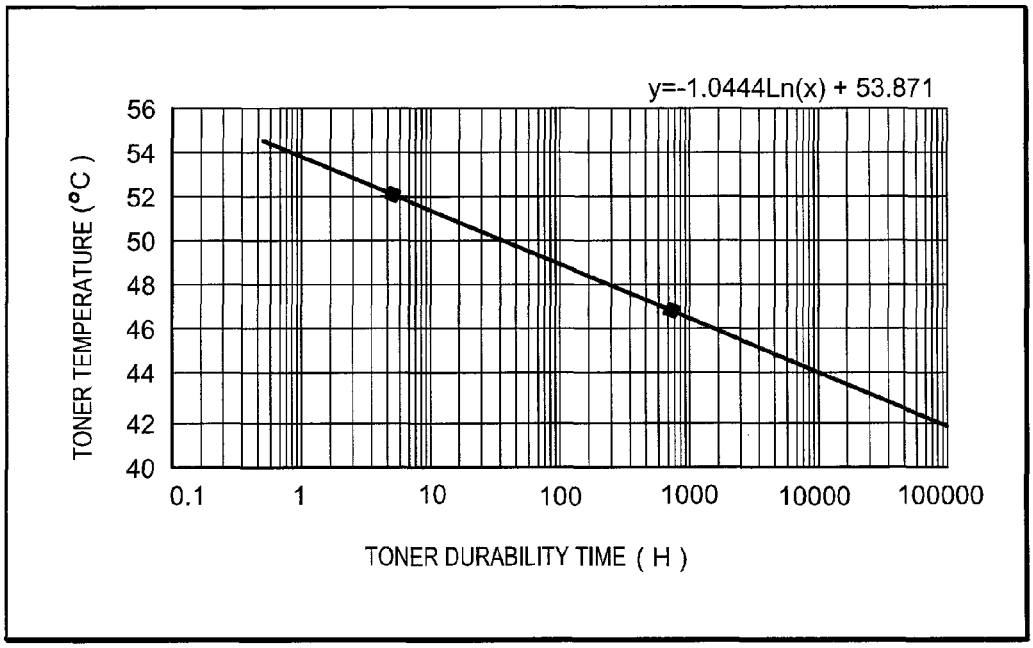
FIG. 6 is a graph showing a relation of toner durability time and toner temperature in embodiment of the present invention.

A relation between a toner temperature that was previously measured by an experiment and a durability time spent till the toner solidifies at the toner temperature, is shown in the FIG. 6. In the FIG. 6, for example, when the toner temperature is equal to 54° C., the toner durability time is one hour. Further, in the FIG. 6, for example, when the toner temperature is equal to 49° C., the toner durability time is 100 hours. Therefore, for preventing the solidification of the toner, it is necessary to maintain the temperature inside the image formation unit 6 to be 54° C. or less.

Then, the temperature inside the image formation unit 6, when a print process in the image forming apparatus 100 is completed, rises in a form called overshoot by the influence heat outputted from the image fixing unit 8. Here, a relation between the print medium conveyance speed that was previously measured by an experiment and a rise temperature inside the image formation unit 6 in the overshoot is shown in the FIG. 7. In the FIG. 7, for example, when the print medium conveyance speed is equal to 10 ppm, the rise temperature is 7° C. Further, in the FIG. 7, for example, when the print medium conveyance speed is equal to 20 ppm, the rise temperature is 12° C.

Therefore, when the print medium conveyance speed is 20 ppm, by considering that the rise temperature caused by overshoot is 12° C., a temperature of 42° C. is obtained by deducting the rise temperature 12° C. from a threshold value 54° C. of toner temperature for preventing the solidification of the toner stated above; and is set as a threshold value of a temperature inside the image forming unit 6, also as a threshold value of a temperature of the apparatus side thermistor 11. By this, as shown by FIG. 5, when the apparatus side temperature that was detected by the apparatus side thermistor 11 is 42° C. or less, the print control prescription information kept in the print control prescription information storing section 110 is set for controlling the print medium conveyance speed is at 20 ppm. Here, when the print medium conveyance speed is 20 ppm, a heating roller prescription temperature is set into 170° C. on the basis of a result obtained from an experiment concerning the image forming apparatus 100.

Further, when the print medium conveyance speed is 10 ppm, by considering that the rise temperature caused by overshoot is 7° C., a temperature of 47° C. is obtained by deducting the rise temperature 7° C. from a threshold value 54° C. of toner temperature for preventing the solidification of the toner stated above; and is set as a threshold value of a temperature inside the image forming unit 6, also as a threshold value of a temperature of the apparatus side thermistor 11. By this, as shown by FIG. 5, when the apparatus side temperature that was detected by the apparatus side thermistor 11 is higher than 42° C. but is 47° C. or less, the print control prescription information kept in the print control prescription information storing section 110 is set for controlling the print medium conveyance speed is at 10 ppm. Here, when the print medium conveyance speed is 10 ppm, a heating roller prescription temperature is set into 130° C. on the basis of a result obtained from an experiment concerning the image forming apparatus 100.

Furthermore, when the apparatus side temperature exceeds 47° C., because it is necessary to fall the surface temperature of the heating roller 81 for preventing the solidification of the toner, as shown by FIG. 5, the print control prescription information kept in the print control prescription information storing section 110 is set for stopping the supply of the high voltage for heating the heater 811 that was set up inside the heating roller 81; and for stopping the supply of the voltage to respective motors used to rotate respective rollers used to convey the print medium.

The apparatus controlling section 101, when stored the image data into the image memory 102, on the basis of the apparatus side temperature that is detected by the apparatus side thermistor 11, searches the print control prescription information kept in the print control prescription information storing section 110; if the apparatus side temperature is 42° C. or less, instructs the motor controlling section 105 to convey the print medium at the print medium conveyance speed of 20 ppm corresponding to the apparatus side temperature; and instructs the high voltage controlling section 103 to supply a high voltage to the heater 811 that was set up in the heating roller 81 for making the surface temperature of the heating roller 81 become 170° C.

Then, the apparatus controlling section 101, when the apparatus side temperature is higher than 42° C. but is 47° C. or less, on the basis of the print control prescription information, instructs the motor controlling section 105 to convey the print medium at the print medium conveyance speed of 10 ppm corresponding to the apparatus side temperature; and instructs the high voltage controlling section 103 to supply a high voltage to the heater 811 that was set up in the heating roller 81 for making the surface temperature of the heating roller 81 become 130° C.

Further, the apparatus controlling section 101, when the apparatus side temperature exceeds 47° C., on the basis of the print control prescription information, instructs the motor controlling section to stop the drive of all motors in the image forming apparatus 100; and instructs the high voltage controlling section 103 to stop the supply of the high voltage to the heater 811 that was set up in the roller of the heating roller 81.

The motor controlling section 105, when received an instruction to stop the drive of all motors, stops the supply of the voltage outputted from the power source section 104 with respect to all motors in the image forming apparatus 100. By this, the drive of all motors in the image forming apparatus 100 is stopped.

The high voltage controlling section 103, when received an instruction to stop the supply of the high voltage to the heater 811 that was set up inside the heating roller 81, stops the supply of the high voltage outputted from the power source section 104 to the heater 811. By this, because the heater 811 stops to heat, so a heating process performed for the heating roller 81 and performed by the heater 811 is stopped.

When the drive of all motors in the image forming apparatus 100 is stopped and the heating process of the heating roller 81 is stopped by the heater 811 that was set up in the roller of the heating roller 81, the apparatus controlling section 101 performs operation to turn on or off the LED (Light Emitting Diode) on a displayer provided in a displaying section (not shown) of the image forming apparatus 100 for notifying user of a message that the temperature of the heater 811 is in adjusting, per 2 seconds; and generates a heater temperature adjustment signal for transmitting the message that the temperature of the heater is in adjusting with respect to a host apparatus that is a sending destination of image data in print process, and sends the signal to the host apparatus.

The host apparatus, when received the heater temperature adjustment signal, executes a control program in a memory (not shown) of the host apparatus, for example, to display a display scene including a message of "fixation temperature is in adjusting" onto a displayer in a displaying section (not shown) of the host apparatus. By this, user can grasp print process situation of image data that was sent from the host apparatus.

Later, the apparatus controlling section 101, when the apparatus side temperature that is detected by the apparatus side thermistor 11 becomes 47° C. or less, instructs the motor controlling section 105 to convey the print medium at the print medium conveyance speed of 10 ppm corresponding to the apparatus side temperature; and instructs the high voltage controlling section 103 to supply a high voltage to the heater 811 that was set up inside the heating roller 81 for making the surface temperature of the heating roller 81 become 130° C.

The motor controlling section 105, when received an instruction to convey the print medium at either of print medium conveyance speeds 10 ppm and 20 ppm, supplies a voltage outputted from the power source section 104 to the conveying roller drive motor 107, the fixation motor 106, the drum motor 108 and the ejecting roller drive motor 109 to drive, so as to control the conveying roller 3, the heating roller 81, the photosensitive drum 61 and the ejecting roller 9 to convey the print medium at either of the print medium conveyance speeds 10 ppm and 20 ppm.

The high voltage controlling section 103, when received an instruction to supply the high voltage to the heater 811 for setting either of the heating roller prescription temperatures 130° C. and 170° C., supplies the high voltage outputted from the power source section 104 to the heater 811 so as to make the heating roller surface temperature that is detected by the heating roller use thermistor 12 become either of 130° C. and 170° C.

When the print medium whose print process has been ended is ejected from an ejection opening (not shown) of the image forming apparatus 100, the apparatus controlling section 101 searches the image memory 102 for judging whether or not the image data whose print process has been ended belongs to a last page. On the one hand, if it is the last page, the apparatus controlling section 101 instructs the motor controlling section 105 to stop the drive of all motors and instructs the high voltage controlling section 103 to stop the supply of the high voltage. Here, because the judgment method to judge whether or not the image data corresponds to the last page is well known, its explanation is omitted.

On the other hand, the apparatus controlling section 101, when the image data whose print process was completed belongs to the last page, on the basis of the apparatus side temperature that is detected by the apparatus side thermistor 11, searches the print control prescription information kept in the print control prescription information storing section 110; instructs the motor controlling section 105 to convey the print medium at a print medium conveyance speed corresponding to the falling under apparatus side temperature; and instructs the high voltage controlling section 103 to supply a high voltage to the heater 811 that was set up inside the heating roller 81 so as to make the heating roller prescription temperature correspond to the apparatus side temperature.

Operation of Embodiment

Figure 8:
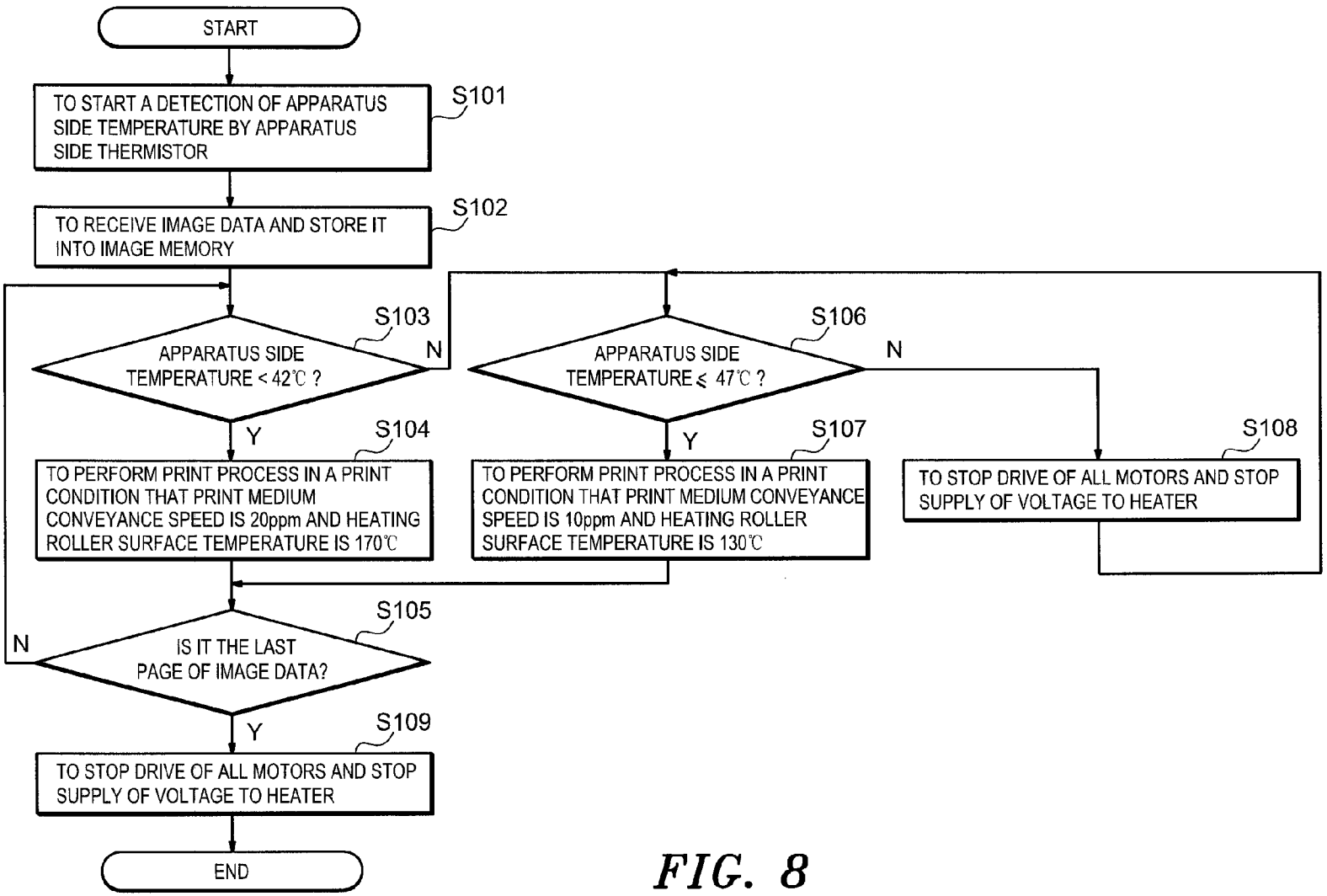
FIG. 8 is a flowchart showing operations of an image forming apparatus of the present invention.

Next, it is to explain operation of the image forming apparatus 100 of the embodiment of the present invention by using a flowchart of the FIG. 8. Here, as a precondition, image data that was received from the host apparatus by the image forming apparatus 100 is composed of plural pages (i.e. data of plural pages) of A4 size.

When a switch (not shown) of the image forming apparatus 100 is pressed and a voltage outputted from the power source section 104 is supplied, the apparatus side thermistor 11 detects a temperature in the predetermined location of the apparatus side (Step 101), the heating roller use thermistor 12 detects a fixing roller surface temperature representing a temperature on the surface of the heating roller 81 in which the heater 811 is set up.

The apparatus controlling section 101 obtains temperature detection signals from the apparatus side temperature 11 and the heating roller use thermistor 12 on the basis of the apparatus side temperature and the fixing roller surface temperature.

The apparatus controlling section 101 of the image forming apparatus 100, when received image data from the host apparatus connected with the image forming apparatus 100 via network through the interface (I/F) (not shown) of the image forming apparatus 100, stores the image data into the image memory 102 (Step 102).

When the image data is stored in the image memory 102, through a control of the apparatus controlling section 101, the motor controlling section 105 supplies a voltage of the power source section 104 to the medium stage drive motor (not shown) and the paper feeding roller drive motor (not shown) of the image forming apparatus 100 to drive the medium stage drive motor and the paper feeding roller drive motor.

On the one hand, through the drive of the medium stage drive motor stated above and through a control of the motor controlling section 105, the medium stage 2 moves upwardly so that the front edge of the print medium on the most upside in the medium stage 2 reach a height of conveyance route. Through moving the medium stage 2 upwardly, the print medium on the most upside is sent toward the paper feeding roller (not shown) of the image forming apparatus 100.

On the other hand, through the drive of the paper feeding roller drive motor, the paper feeding roller (not shown) of the image forming apparatus 100 starts to rotate. By this, the paper feeding roller conveys the print medium that was sent from the medium stage 2 for paper feeding.

When the apparatus side thermistor 11 detects the apparatus side temperature (for example, 30° C.) together with the paper feeding roller paper feeds the print medium, the apparatus controlling section 101 searches the print control prescription information kept in the print control prescription information storing section 110 on the basis of the apparatus side temperature, because the apparatus side temperature is under 42° C. (Step 103), the apparatus controlling section 101 instructs the motor controlling section 105 to convey the print medium at the print medium conveyance speed of 20 ppm corresponding to the apparatus side temperature; and instructs the high voltage controlling section 103 to supply the high voltage to the heater 811 that was set up in the heating roller 81 for making the surface temperature of the heating roller 81 become 170° C.

The motor controlling section 105, when received an instruction to convey the print medium at a print medium conveyance speed of 20 ppm, supplies a voltage outputted from the power source section 104 to the conveying roller drive motor 107, the fixation motor 106, the drum motor 108 and the ejecting roller drive motor 109 to drive, so as to control the conveying roller 3, the heating roller 81, the photosensitive drum 61 and the ejecting roller 9 to convey the print medium at the print medium conveyance speed of 20 ppm.

The high voltage controlling section 103, when received an instruction to supply high voltage to the heater 811 for making the heating roller prescription temperature become 170° C., supplies the high voltage outputted from the power source section 104 to the heater 811 so as to make the heating roller surface temperature that is detected by the heating roller use thermistor 12 become 170° C.

When the front edge of the print medium that is sandwiched and conveyed by the conveying roller 3 and the pressing roller 4 reaches the passage sensor 5, through a control of the apparatus controlling section 101, the charging roller 62 charges the surface of the photosensitive drum 61.

When the surface of the photosensitive drum 61 is charged, for example, the LED head 63 composed of LED (Light Emitting Diode) arrays emits light through a control of the apparatus controlling section 101, forms an electrostatic latent image based on the image data kept in the image memory 102 onto the surface of the charging photosensitive drum 61. Here, the electrostatic latent image on the surface of the charging photosensitive drum 61, through a control of the apparatus controlling section 101, is formed according to a position of the front edge of the print medium.

When the electrostatic latent image is formed on the surface of the photosensitive drum 61, the toner that is contained in the toner tank 64, through a control of the apparatus controlling section 101, is used to develop the electrostatic latent image on the photosensitive drum 61 via the developing roller 65. By this, on the surface of the photosensitive drum 61, a toner image that corresponds to the electrostatic latent image is formed as a visible image.

When the toner image is formed on the photosensitive drum 61, through a control of the apparatus controlling section 101, the print medium is sandwiched to be conveyed by the photosensitive drum 61 and the transferring roller 7; and the toner image on the surface of the photosensitive drum 61 is transferred on the print medium by the transferring roller 7. Here, the transferring roller 7 is provided with a high voltage outputted from the power source section 104 through a control of the apparatus controlling section 101.

After the toner image on the surface of the photosensitive drum 61 is transferred on the print medium, toner (i.e. remainder toner) remaining on the surface of the photosensitive drum 61 is scraped to be removed by the cleaning blade 66. Then, the scraped remainder toner is collected by the remainder toner collecting section 67.

When the toner image on the surface of the photosensitive drum 61 is transferred on the print medium, through a control of the apparatus controlling section 101, the surface of the heating roller 81 is heated by the heater 811 that was set up in the heating roller 81 till a heating roller prescription temperature stated later. Here, through a control of the apparatus controlling section 101, the heater 811 is supplied with the high voltage outputted from the power source section 104 via the high voltage controlling section 103, for heating.

Then, when the print medium on which the toner image was transferred is sandwiched to be conveyed by the heating roller 81 that has been heated to the heating roller prescription temperature and by the pressing roller 82 that was set up to face to the heating roller 81, the toner image on the print medium is heated and pressed by the heating roller 81 and the pressing roller 82, then is fixed on the print medium.

The print medium that was performed by a fixation process through the heating roller 81 and the pressing roller 82 is sandwiched to be conveyed by the rotating ejecting roller 9 and the pressing roller 10 that was set up to face to the ejecting roller 9; and is ejected from an ejection opening (not shown) of the image forming apparatus 100 (Step 104).

When ejected the print medium whose print process is ended from the ejection opening (not shown) of the image forming apparatus 100, the apparatus controlling section 101 searches the image memory 102 for judging whether or not the image data whose print process was completed is the last page (Step 105). When a print of the plural pages is completed and the apparatus side thermistor 11 detects that the apparatus side temperature is, for example, 43.5° C., the apparatus controlling section 101 searches the print control prescription information kept in the print control prescription information storing section 110 on the basis of the apparatus side temperature (for example 43.5° C.). Because the apparatus side temperature is higher than 42° C. and is under 47° C. (Step 106), the apparatus controlling section 101 instructs the motor controlling section 105 to convey the print medium at the print medium conveyance speed of 10 ppm corresponding to the apparatus side temperature; and instructs the high voltage controlling section 103 to supply the high voltage to the heater 811 that was set up in the heating roller 81 for making the surface temperature of the heating roller 81 become 130° C.

The motor controlling section 105, when received an instruction to convey the print medium at a print medium conveyance speed of 10 ppm, supplies a voltage outputted from the power source section 104 to the conveying roller drive motor 107, the fixation motor 106, the drum motor 108 and the ejecting roller drive motor 109 to drive, so as to control the conveying roller 3, the heating roller 81, the photosensitive drum 61 and the ejecting roller 9 to convey the print medium at the print medium conveyance speed of 10 ppm.

The high voltage controlling section 103, when received an instruction to supply high voltage to the heater 811 for making the heating roller prescription temperature become 130° C., supplies the high voltage outputted from the power source section 104 to the heater 811 so as to make the heating roller surface temperature that is detected by the heating roller use thermistor 12 become 130° C. Later, the image forming apparatus 100, forms and fixes a toner image onto the print medium on the basis of image data of second page, and ejects the print medium from the ejection opening (not shown) of the image forming apparatus 100 (Step 107).

When ejected the print medium whose print process is ended from the ejection opening (not shown) of the image forming apparatus 100, the apparatus controlling section 101 searches the image memory 102 for judging whether or not the image data whose print process was completed is the last page (Step 105). Even if the remaining page is existent, when the apparatus side thermistor 11 detects that the apparatus side temperature is, for example, 47.1° C., the apparatus controlling section 101 searches the print control prescription information kept in the print control prescription information storing section 110 on the basis of the apparatus side temperature (for example 47.1° C.). Because the apparatus side temperature exceeds 47° C. (Step 106), the apparatus controlling section 101 instructs the motor controlling section to stop the drive of all motors in the image forming apparatus 100 on the basis of the print control prescription information; and instructs the high voltage controlling section 103 to stop the supply of the high voltage to the heater 811 that was set up in the heating roller 81.

The motor controlling section 105, when received an instruction to stop the drive of all motors, stops the supply of the voltage outputted from the power source section 104 with respect to all motors in the image forming apparatus 100. By this, the drive of all motors in the image forming apparatus 100 is stopped.

The high voltage controlling section 103, when received an instruction to stop the supply of the high voltage to the heater 811 that was set up in the roller of the heating roller 81, stops the supply of the high voltage outputted from the power source section 104 to the heater 811. By this, because the heater 811 is stopped to heat, so the heating process of the heater 811 is stopped for the heating roller 81.

When the drive of all motors in the image forming apparatus 100 is stopped and the heating process which is performed for the heating roller 81 and is executed by the heater 811 that was set up in the heating roller 81 is stopped, the apparatus controlling section 101 performs operation to turn on or off the LED (Light Emitting Diode) on a displayer provided in a displaying section (not shown) of the image forming apparatus 100 for notifying user of a message that the temperature of the heater 811 is in adjusting, per 2 seconds; and generates a heater temperature adjustment signal for transmitting the message that the temperature of the heater is in adjusting with respect to a host apparatus that is a sending destination of image data in print process, and sends the signal to the host apparatus.

The host apparatus, when received the heater temperature adjustment signal, executes a control program in a memory (not shown) of the host apparatus, for example, to display a display scene including a message of "fixation temperature is in adjusting" onto a displayer in a displaying section (not shown) of the host apparatus. By this, user can grasp print process situation of image data that was sent from the host apparatus.

Later, the apparatus controlling section 101, when the apparatus side temperature that is detected by the apparatus side thermistor 11 becomes 47° C. or less, instructs the motor controlling section 105 to convey the print medium at the print medium conveyance speed of 10 ppm corresponding to the apparatus side temperature; and instructs the high voltage controlling section 103 to supply a high voltage to the heater 811 that was set up inside the heating roller 81 for making the surface temperature of the heating roller 81 become 130° C. Later, the image forming apparatus 100, restarts a print of remainder print medium, forms and fixes a toner image onto the print medium on the basis of image data, and ejects the print medium from the ejection opening (not shown) of the image forming apparatus 100 (Step 108).

When the print medium whose print process has been ended is ejected from an ejection opening (not shown) of the image forming apparatus 100, the apparatus controlling section 101 searches the image memory 102 for judging whether or not the image data whose print process has been ended is a last page (Step 109). Because it is the last page, the apparatus controlling section 101 instructs the motor controlling section 105 to stop the drive of all motors and instructs the high voltage controlling section 103 to stop the supply of the high voltage.

The motor controlling section 105, when received an instruction to stop of the drive of all motors, stops the supply of the voltage outputted from the power source section 104 with respect to all motors in the image forming apparatus 100. By this, the drive of all motors in the image forming apparatus 100 is stopped.

The high voltage controlling section 103, when received an instruction to stop the supply of the high voltage to the heater 811 that was set up in the heating roller 81, stops the supply of the high voltage outputted from the power source section 104 to the heater 811. By this, because the heater 811 is stopped to heat, so the heating process which is performed for the heating roller 81 and is executed by the heater 811 is stopped.

Effect of Embodiment

According to the image forming apparatus 100 of the embodiment of the present invention, in a back location of the conveyance route frame 130 at apparatus side, where a distance from the heater that was set up in the heating roller 81 is equal to a distance from the heater to a prescription location inside the image formation unit 6, the apparatus side thermistor 11 is set up. Thereby, because the apparatus side thermistor 11 is influenced by heat produced from the heater and detects a temperature in the same condition as it is in the image forming section, it is possible to obtain a correct temperature inside the image forming unit 6 and perform an optimum temperature control, by this, it is possible to prevent an adherence of the remainder toner on the surface of the photosensitive drum 61 or the like.

Moreover, in the embodiment of the present invention, on the basis of the apparatus side temperature that is detected by the apparatus side thermistor 11, the supply of the high voltage for heating to the heater so as to make the surface temperature of the heating roller 81 become either of 130° C. and 170° C. is controlled. However, in order to more correctly perform the temperature control in the image formation unit 6, a control can also be performed to make the temperature become one of 130° C., 155° C. and 170° C. including 155° C. that is a middle temperature of 130° C. and 170° C. In the FIG. 9, print control prescription information is shown in the case to control the surface temperature of the heating roller 81 at 155° C.

Figure 7:
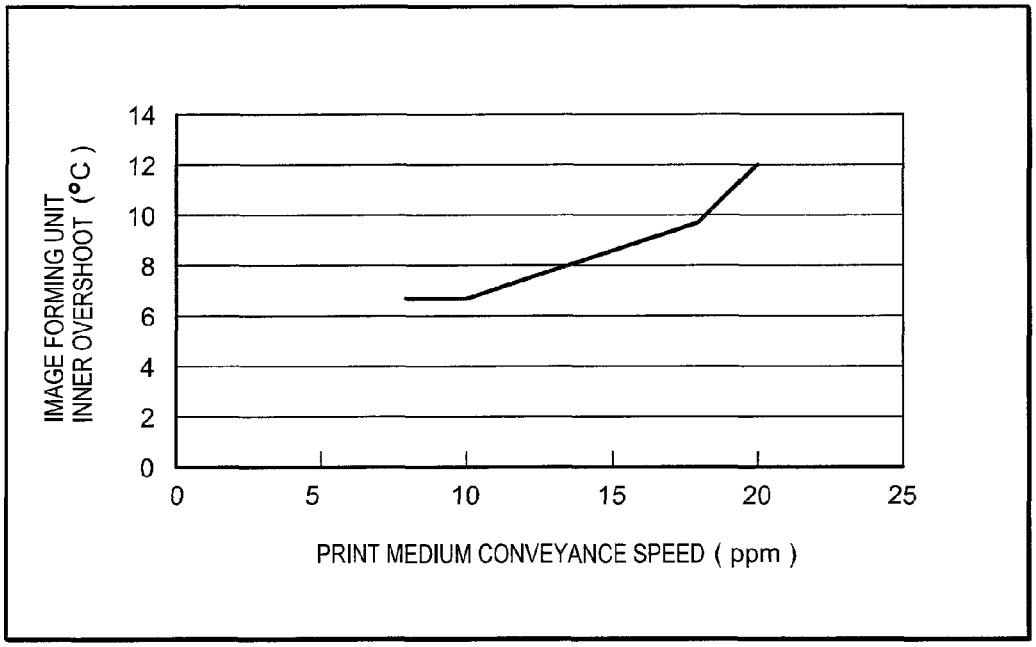
FIG. 7 is a graph showing a relation of a print medium conveyance speed and an overshoot in an image forming unit.

In the structure stated above, according to experiment data representing a relation between the print medium conveyance speed and the rise temperature caused by overshoot inside the image formation unit 6 as shown by FIG. 7, when the print medium conveyance speed is 16 ppm, the rise temperature caused by the overshoot is 9° C. Therefore, when the print medium conveyance speed is 16 ppm, by considering that the rise temperature caused by overshoot is 9° C., a temperature of 45° C. is obtained by deducting the rise temperature 9° C. from a threshold value 54° C. of toner temperature for preventing the solidification of the toner stated above; and is set as a threshold value of a temperature inside the image forming unit 6, also as a threshold value of a temperature of the apparatus side thermistor 11. By this, as shown by FIG. 9, when the apparatus side temperature that was detected by the apparatus side thermistor 11 is 45° C. or less, the print control prescription information kept in the print control prescription information storing section 110 is set for controlling the print medium conveyance speed is at 16 ppm. Here, when the print medium conveyance speed is 16 ppm, a heating roller prescription temperature is set into 155° C. on the basis of a result obtained from an experiment concerning the image forming apparatus 100.

Further, in the structure stated above, as shown by FIG. 9, when the apparatus side temperature that was detected by the apparatus side thermistor 11 is higher than 45° C. but is 47° C. or less, the print control prescription information kept in the print control prescription information storing section 110 is set for controlling the print medium conveyance speed is at 20 ppm.

THE UTILIZATION POSSIBILITY IN INDUSTRY

In the embodiment stated above, the present invention is applied to the image forming apparatus 100 as a printer. However, the present invention is not limited in the case, it is also can be applied to such image forming apparatus as facsimile apparatus, copying apparatus, MFP (Multi Function Products) or the like.

The present invention is not limited to the foregoing embodiment or example but many modifications and variations are possible within the spirit and scope of the appended claims of the invention.

What is claimed is:

1. An image forming apparatus to heat and fix a toner image onto a print medium, comprising:

an image forming section that forms the toner image on a surface of an image carrying body;

a conveying section that conveys the print medium;

a transferring section that transfers the toner image on the image carrying body onto the print medium conveyed by the conveying section;

a fixing section that heats and fixes the toner image transferred onto the print medium;

a fixing section temperature detection section that detects a temperature of the fixing section;

an apparatus controlling section configured to control the temperature of the fixing section on the basis of a detection result of the fixing section temperature detection section; and an inner temperature detection section that detects an inner temperature of the image forming apparatus, wherein the inner temperature detection section is placed at a predetermined location outside of the image forming section so that the inner temperature detection section receives about the same quantity of heat as a toner accommodating section inside of the image forming section receives from the fixing section, the apparatus controlling section is further configured to control the temperature of the fixing section on the basis of a detection result of the inner temperature detection section.

2. The image forming apparatus according to claim 1, wherein the toner accommodating section accommodates waste toner.

3. The image forming apparatus according to claim 1, wherein a distance from the inner temperature detection section to the fixing section is equal to a distance from the toner accommodating section to the fixing section.

4. The image forming apparatus according to claim 1, wherein a mold member between the inner temperature detection section and the fixing section, and a mold member between the toner accommodating section and the fixing section are formed from identical material.

5. The image forming apparatus according to claim 4, wherein the mold member between the inner temperature detection section and the fixing section, and the mold member between the toner accommodating section and the fixing section have an identical thickness.

6. The image forming apparatus according to claim 1, wherein the apparatus controlling section is further configured to control the temperature of the fixing section so as to make the inner temperature of the image forming apparatus that is detected by the inner temperature detection section become a prescription temperature that is set on the basis of a durability temperature at which the toner does not solidify and which is previously obtained by a temperature of overshoot caused by heat influence from the fixing section.

7. The image forming apparatus according to claim 1, wherein the apparatus controlling section is further configured to control the temperature of the fixing section such that a sum of the inner temperature detected by the inner temperature detection section and a rise temperature caused by overshoot after the image forming section stops is lower than a temperature at which the toner solidifies after a predetermined time.

8. The image forming apparatus according to claim 1, further comprising:

a conveyance speed control section that controls a conveyance speed of the print medium in the conveying section on the basis of the inner temperature of the image forming apparatus that is detected by the inner temperature detection section.

9. The image forming apparatus according to claim 8, wherein when the inner temperature of the image forming apparatus detected by the inner temperature detection section is a first temperature or less, the conveyance speed control section controls the conveyance speed so that the conveying section conveys the print medium at a first speed; and wherein when the inner temperature of the image forming apparatus detected by the inner temperature detection section is higher than the first temperature, the conveyance speed control section controls the conveyance speed so that the conveying section conveys the print medium at a second speed that is slower than the first speed.

10. The image forming apparatus according to claim 9, wherein when the inner temperature of the image forming apparatus that is detected by the inner temperature detection section exceeds a second temperature, which is higher than the first temperature, the conveyance speed control section controls the conveyance speed so that the conveying section stops conveying the print medium.

11. The image forming apparatus according to claim 1, wherein the inner temperature detection section is placed at an upstream side of the fixing section temperature detection section in a conveyance direction of the print medium.

* * * * *